US006585266B1

(12) United States Patent
Lovell

(10) Patent No.: US 6,585,266 B1
(45) Date of Patent: Jul. 1, 2003

(54) BINGO GAME CARD

(76) Inventor: John Lovell, 3222 Rudy Ave., Knoxville, TN (US) 37921

( * ) Notice: Subject to any disclaimer, the term of this patent is extended or adjusted under 35 U.S.C. 154(b) by 0 days.

(21) Appl. No.: 10/120,822

(22) Filed: Apr. 11, 2002

(51) Int. Cl.[7] ..... A63F 3/00
(52) U.S. Cl. ..... 273/269
(58) Field of Search ..... 273/269, 270

(56) References Cited

U.S. PATENT DOCUMENTS 4,019,744 A * 4/1977 Pizur, Jr.
4,165,878 A 8/1979 Frain
4,560,171 A * 12/1985 Anthony
4,611,811 A * 9/1986 Haase
5,685,541 A 11/1997 Lovell, Sr.
6,364,313 B1 * 4/2002 Moody

FOREIGN PATENT DOCUMENTS

DE 3125911 * 3/1983
JP 9-19534 * 9/1997

* cited by examiner

*Primary Examiner*—William M. Pierce
(74) *Attorney, Agent, or Firm*—Pitts & Brittian, P.C.

(57) ABSTRACT

A multiple-field game card is provided for playing a game of chance. The game card comprises a matrix of five rows and five columns defining twenty-five grid squares adapted for playing the game of bingo. Each of a first plurality of the grid squares includes a single game symbol representing a number in a range of 1 to 75. Each of a second plurality of the grid squares includes two game symbols representing two numbers in a range of 1 to 75. Each of a third plurality of the grid squares includes three game symbols representing three numbers in a range of 1 to 75.

11 Claims, 3 Drawing Sheets

BINGO GAME CARD

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to bingo game cards.

More particularly, this invention pertains to an improved bingo game card that provides to the players improved odds for winning.

2. Description of the Related Art

In the game of bingo, each player is provided with a card that includes a matrix of five rows and five columns defining twenty-five grid squares. The left-most column is labeled "B", the second column "I", the third column "N", the fourth column "G" and the right-most column "O". Traditionally, each grid square, with the exception of the "free" center grid square, is labeled with a number in the range of 1 to 75. The grid squares in the "B" column use the numbers in the range of 1 to 15. The squares in the "I" column use the numbers in the range of 16 to 30. The grid squares in the "N" column, except the center square, use the numbers in the range of 31 to 45. The grid squares in the "G" column use the numbers in the range of 46 to 60. The grid squares in the "O" column use the numbers in the range of 61 to 75. Each grid square is defined by the combination of a letter identifying the column and a number. As a caller randomly calls combinations of columns and numbers, each player indicates which of that player's grid squares had been called, either through markings in the grid squares or placing items on the squares. The first person to achieve a pre-determined pattern of called grid squares is the winner of that game. Examples of patterns include: one straight line, two straight lines; the entire card, the border of the grid, etc.

The game of bingo has developed into a substantial form of gambling in which players purchase cards and winners are rewarded with prizes, frequently in the form of cash. The game is simple enough for almost anyone to play and it gives the players a feeling of involvement in the game of chance. In a casino environment it is generally desirable to have the bingo games achieve a winner as frequently as possible so that more games can be played in a shorter time period. More games being played means that there will be more winners. Players who win periodically are more likely to continue playing. More games also mean more revenue for the house.

Various efforts have been made to speed up the games, other than just calling numbers faster. For example, some game cards, such as those sold under the trademark "Double Action Bingo" from Bonus Games Inc., include two numbers in each square. In essence, two separate game cards have been combined into a single game card so that two games can been played at one time. Each game card has the opportunity to be a winner in two separate games called from the same set of numbers. Nevertheless, the basic game is still the same as traditional bingo.

It is an object of the present invention to provide a novel game card for use in a new game of bingo.

It is also an object to provide a game card that permits bingo games to provide a winner with a reduced number of called squares.

Various other objects and advantages will be recognized by those skilled in the art when the following description is considered along with the drawings.

BRIEF SUMMARY OF THE INVENTION

According to one embodiment of the present invention, a bingo card is provided with a matrix of five columns and five rows cooperatively defining twenty-five squares. Each of a first plurality of the grid squares includes a single game symbol representing a number in a range of 1 to 75. These are called "single grid squares." Each of a second plurality of the grid squares includes two game symbols representing two numbers in a range of 1 to 75. These are called "double grid squares." Each of a third plurality of the grid squares includes three game symbols representing three numbers in a range of 1 to 75. These are called "triple grid squares." If any number in a grid square is called, then the grid square is considered covered. For any given call, grid squares with two game symbols are twice as likely to be covered than grid squares with one game symbol. Also, it will be appreciated that for any given call, grid squares with three game symbols are three times as likely to be covered than grid squares with one game symbol. Accordingly, the games played with game cards in accordance with the present invention will generally proceed faster than games using traditional patterns. In addition, the card provides new patterns for determining game winners and the methods by which prizes are paid.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
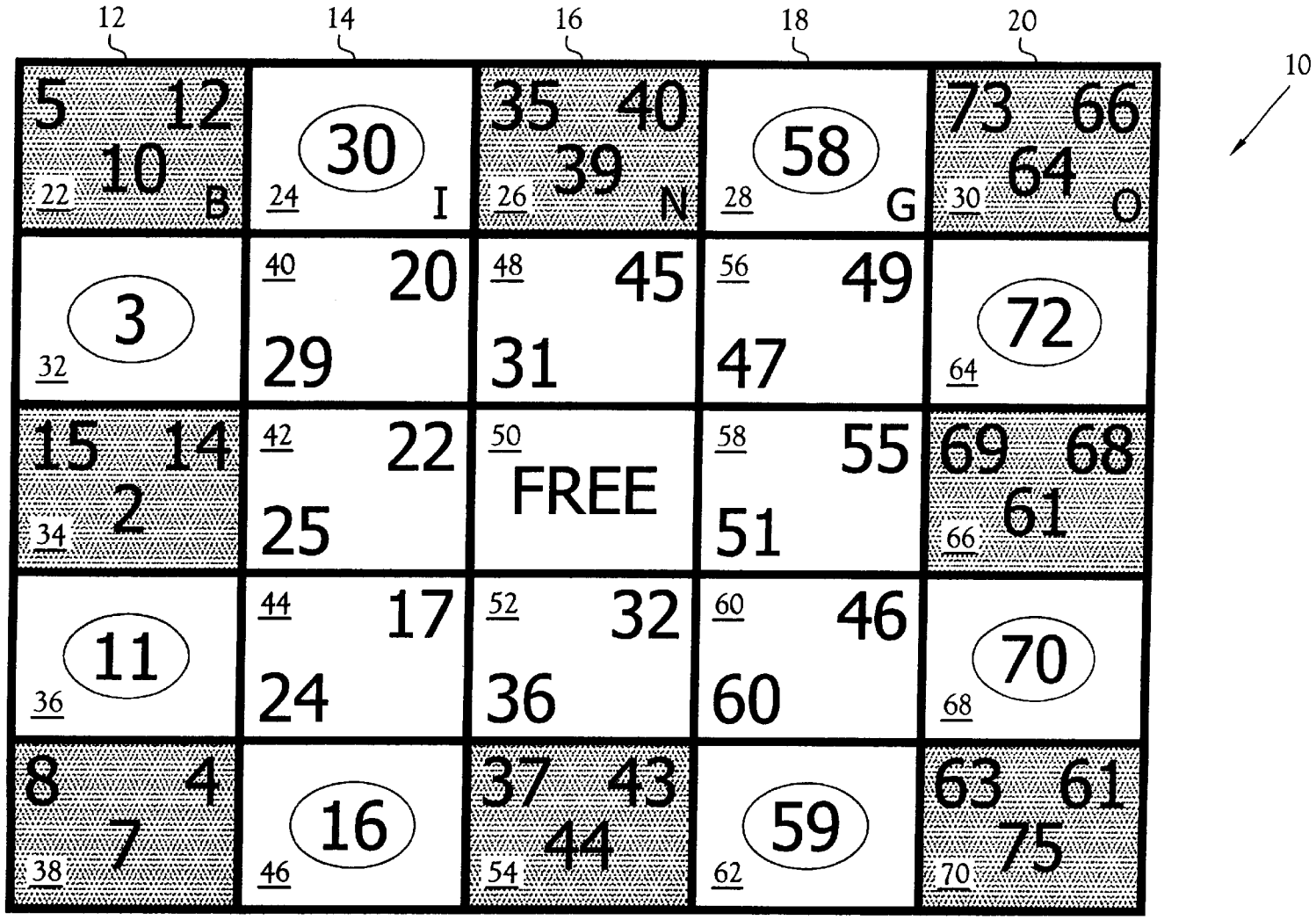
FIG. 1 is a plan view of a game card embodying various of the features of the present invention.

Referring now to FIG. 1, a game card 10 for games of bingo is disclosed. The card 10 includes a grid of five rows and five columns. The left-most column 12 is identified by the letter "B." The next column 14 is identified by the letter "I." The next column 16 is identified by the letter "N." The next column 18 is identified by the letter "G." The right-most column 20 is identified by the letter "O."

The top grid square 22 in column 12 contains three numbers from the range of 1 to 15. The second grid square 32 in column 12 contains one number from the range of 1 to 15. The middle grid square 34 in column 12 contains three numbers from the range of 1 to 15. The fourth grid square 36 in column 12 contains one number from the range of 1 to 15. The bottom grid square 38 in column 12 contains three numbers from the range of 1 to 15.

The top grid square 24 of the column 14 contains one number from the range of 16 to 30. The second grid square 40 of the column 14 contains two numbers from the range of 16 to 30. The third grid square 42 of the column 14 contains two numbers from the range of 16 to 30. The fourth grid square 44 of the column 14 contains two numbers from the range of 16 to 30. The bottom grid square 46 of the column 14 contains one number from the range of 16 to 30.

The top grid square 26 in column 16 contains three numbers from the range of 31 to 45. The second grid square 48 in column 16 contains two numbers from the range of 31 to 45. The middle grid square 50 in column 16 contains no numbers. It will be recognized by those skilled in the art that the center grid square 50 is traditionally referred to as the "free square." The fourth grid square 52 in column 16 contains two numbers from the range of 31 to 55. The bottom grid square 54 in column 16 contains three numbers from the range of 31 to 45.

The top grid square 28 of the column 18 contains one number from the range of 46 to 60. The second grid square 56 of the column 18 contains two numbers from the range of 46 to 60. The third grid square 58 of the column 18 contains two numbers from the range of 46 to 60. The fourth grid square 60 of the column 18 contains two numbers from the range of 46 to 60. The bottom grid square 62 of the column 18 contains one number from the range of 46 to 60.

The top grid square 30 in column 20 contains three numbers from the range of 61 to 75. The second grid square 64 in column 20 contains one number from the range of 61 to 75. The middle grid square 66 in column 20 contains three numbers from the range of 61 to 75. The fourth grid square 68 in column 18 contains one number from the range of 61 to 75. The bottom grid square 70 in column 18 contains three numbers from the range of 61 to 75.

Each of the triple grid squares is shaded to differentiate it from the single grid squares and the double grid squares. Each of the single grid squares includes an oval surrounding the number to differentiate it from the double grid squares and triple grid squares. Preferably, the eight double grid squares 40, 42, 44, 48, 56, 58 and 60 are arranged to surround the free center square 50 and the eight single grid squares 24, 28, 64, 68, 62, 46, 36 and 32 are arranged in an alternating pattern with the eight triple grid squares 22, 34, 38, 16, 54, 30, 66 and 70 in the outermost rows and columns. It will be recognized, however, that other patterns of grid squares may be used and that the game card of the present invention may be provided with differing numbers of single, double and triple grid squares.

The game card 10 may be used in a similar fashion as in conventional bingo games in which a winner is defined as a covered straight line, two straight lines, three lines, two lines across, two lines down, or complete coverage, for example. These games will proceed faster than traditional games because the odds of covering double grid squares and triple grid squares are substantially greater than the odds of covering a single grid square for a given call. Alternatively the card may be used in new games in which coverage of all the triple grid squares wins a low level prize, coverage of all the double grid squares wins a mid-level prize and coverage of all the single grid squares wins a high level prize. These prizes may be awarded in a single game or in three separate games.

The game card 10 may also be used for a game in which the prize grows. For example, the basic prize for the game may be $50.00. A bonus prize starting at $50.00 is also available. Each time a win is achieved by covering all triple grid squares on a card, the winner receives the basic $50.00 award. If the win is achieved by covering all double grid squares, the winner receives the basic prize plus ½ of the bonus ($75.00 in the example). If the win is achieved by covering all single grid squares, the winner receives the basic prize and the full bonus ($100.00 in the example). In addition, the bonus prize may be increased by adding a supplement each time that a win is achieved with either double or triple grid squares. When a win is achieved with single grid squares, the winner gets the total of the regular prize and whatever has accumulated in the bonus prize.

Figure 2:
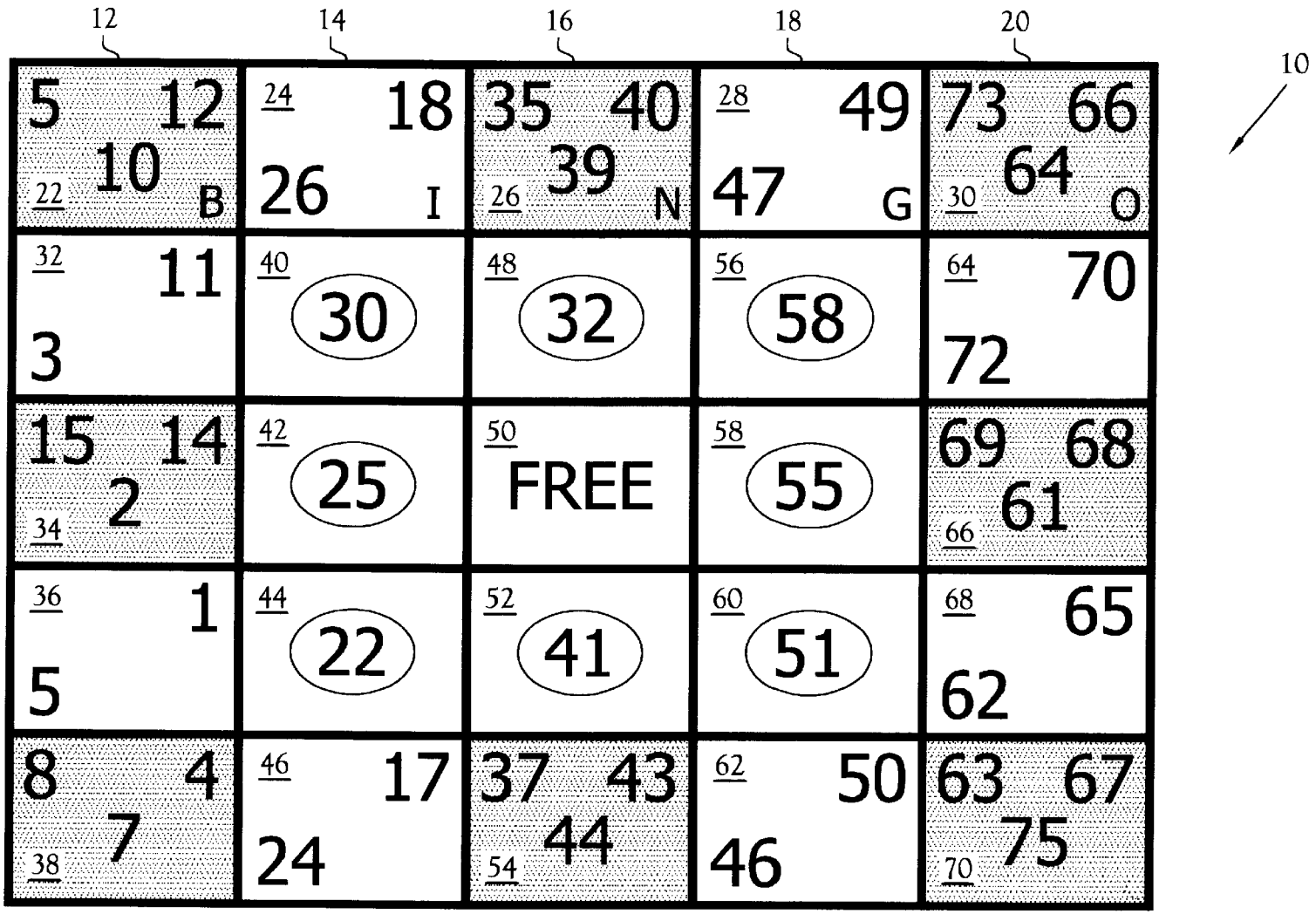
FIG. 2 is a plan view of an alternative embodiment of a game card embodying various of the features of the present invention.
Figure 3:
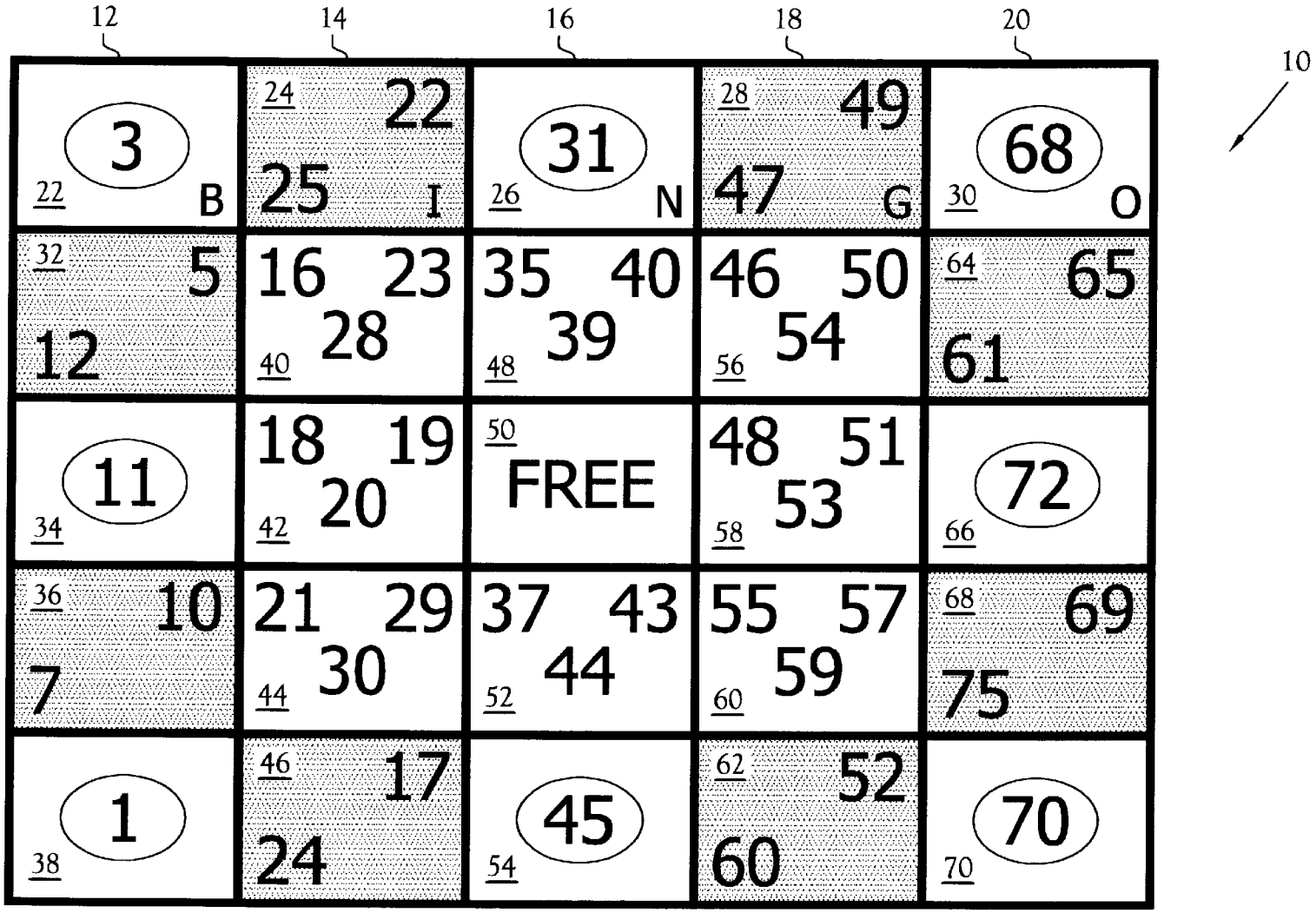
FIG. 3 is a plan view of another alternative embodiment of a game card embodying various of the features of the present invention.

The arrangement of the grid squares, wherein the double grid squares surround the free cell and the single and triple grid squares provide an alternating border, allows the user to easily recognize when the desired coverage has occurred. In addition, the extra indicia identifying the type of grid square (for example, the shading of the triple grid squares and the ovals added to the single grid squares) also provide easy recognition of the type of square to be covered. In an alternative embodiment depicted in FIG. 2, single grid squares surround the center grid square 50 and double grid squares alternate with triple grid squares to form the outer border. In another alternative embodiment depicted in FIG. 3, triple grid squares surround the center grid square 50 and double grid squares alternate with single grid squares to form the outer border.

From the foregoing description, it will be recognized by those skilled in the art that a new and improved bingo game card has been provided, one which allows greater speed of play and also provides additional methods for playing games of bingo.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. A multiple-field game card for playing a game of chance, said game card comprising:

a matrix of five rows and five columns defining twenty five grid squares adapted for playing the game of bingo;

each of a first plurality of said grid squares comprising single grid squares including one game symbol representing a number in a range of 1 to 75;

each of a second plurality of said grid squares comprising double grid squares including two game symbols representing two numbers in a range of 1 to 75; and each of a third plurality of said grid squares comprising triple grid squares including three game symbols representing three numbers in a range of 1 to 75.

2. A game card in accordance with claim 1 wherein said game card includes eight single grid squares wherein one game symbol is located.

3. A game card in accordance with claim 2 wherein said eight single grid squares surround a center grid square.

4. A game card in accordance with claim 1 wherein said game card includes eight double grid squares wherein two game symbols are located.

5. A game card in accordance with claim 4 wherein said eight double grid squares surround a center grid square.

6. A game card in accordance with claim 1 wherein said game card includes eight triple grid squares wherein three game symbols are located.

7. A game card in accordance with claim 6 wherein said triple grid squares surround a center grid square.

8. A game card in accordance with claim 1 wherein said single grid squares and said triple grid squares are arranged in the outermost rows and columns in an alternating pattern.

9. A game card in accordance with claim 1 wherein said double grid squares and said triple grid squares are arranged in the outermost rows and columns in an alternating pattern.

10. A game card in accordance with claim 1 wherein said single grid squares and said double grid squares are arranged in the outermost rows and columns in an alternating pattern.

11. A game card in accordance with claim 1 wherein indicia located in said grid squares differentiate single grid squares, double grid squares and triple grid squares.

* * * * *